US011358151B2

(12) United States Patent
Köpf et al.

(10) Patent No.: US 11,358,151 B2
(45) Date of Patent: Jun. 14, 2022

(54) FEED HOPPER FOR A MATERIAL PROCESSING DEVICE

(71) Applicant: Kleemann GmbH, Göppingen (DE)

(72) Inventors: Reiner Köpf, Gingen an der Fils (DE); Christian Knoblich, Stuttgart (DE); Elena Burgart, Nürtingen (DE)

(73) Assignee: Kleemann GmbH

( * ) Notice: Subject to any disclaimer, the term of this patent is extended or adjusted under 35 U.S.C. 154(b) by 144 days.

(21) Appl. No.: 16/916,534

(22) Filed: Jun. 30, 2020

(65) Prior Publication Data

US 2021/0001349 A1 Jan. 7, 2021

(30) Foreign Application Priority Data

Jul. 4, 2019 (DE) ..... 10 2019 118 058.9

(51) Int. Cl.
*B02C 23/02* (2006.01)
*B65D 88/30* (2006.01)
(Continued)

(52) U.S. Cl.
CPC ..... *B02C 23/02* (2013.01); *B65D 88/30* (2013.01); *B02C 21/026* (2013.01); *B07B 1/005* (2013.01); *B07B 13/16* (2013.01)

(58) Field of Classification Search
CPC ..... B02C 21/02; B02C 21/026; B02C 23/02; B07B 1/005; B07B 13/16; B65D 88/26;
(Continued)

(56) References Cited

U.S. PATENT DOCUMENTS 4,524,916 A * 6/1985 Keyes ..... A01D 87/127 241/101.76
8,925,712 B2 * 1/2015 Dunn ..... B60P 1/26 198/632
(Continued)

FOREIGN PATENT DOCUMENTS

CA 3019691 A1 * 10/2017 ..... B02C 23/02
CA 3035402 A1 4/2018
(Continued)

OTHER PUBLICATIONS

Machine translation of DE102009020599, Retrieved from Espacenet Jan. 14, 2022, 9 Pages. (Year: 2013).*
(Continued)

*Primary Examiner* — Gregory D Swiatocha
(74) *Attorney, Agent, or Firm* — Lucian Wayne Beavers; Patterson Intellectual Property Law, PC

(57) ABSTRACT

A feed hopper for a material processing device, in particular for a crusher (10), having two side walls (21) and a rear wall of the hopper (22), wherein the side walls (21) are directly or indirectly coupled to a machine support (12.1) in a swiveling manner and can be converted from a set-up work position to a folded-down transport position and back, wherein a feed area is formed between the side walls (21), and wherein at least one of the side walls (21) is supported relative to the machine support (12.1) in the set-up work position by a supporting device (30). A support lever (31), which in the work position is supported directly or indirectly in relation to the machine support (12.1) by a detachable form-fit connection, wherein the form-fit connection prevents the side wall (21) from folding down, projects into the feed area in the folded-down transport position. In this way, a space-saving design is also achieved in the folded-down transport position.

15 Claims, 4 Drawing Sheets

(51) Int. Cl.

| | |
|---|---|
| *B02C 21/02* | (2006.01) |
| *B07B 1/00* | (2006.01) |
| *B07B 13/16* | (2006.01) |

(58) Field of Classification Search
CPC ..... B65D 88/30; B65D 88/52; B65D 88/522; B65D 88/524; B65D 88/526; B65D 88/528
See application file for complete search history.

(56) References Cited

U.S. PATENT DOCUMENTS

| | | | | |
|---|---|---|---|---|
| 9,242,803 | B2 | 1/2016 | Murphy | |
| 9,302,852 | B2 * | 4/2016 | Byrne | B02C 21/02 |
| 9,833,787 | B2 | 12/2017 | McDevitt | |
| 2019/0119046 | A1 * | 4/2019 | Burgart | B02C 23/02 |

FOREIGN PATENT DOCUMENTS

| | | | | |
|---|---|---|---|---|
| CN | 208642807 | U * | 3/2019 | |
| DE | 102009020599 | B4 * | 7/2013 | B65D 90/0086 |
| DE | 102016119797 | B3 | 3/2018 | |
| EP | 2730459 | A2 | 5/2014 | |
| EP | 2949397 | A1 | 12/2015 | |
| GB | 2496522 | A | 5/2013 | |

OTHER PUBLICATIONS

Machine translation of CN208642807, Retrieved from Google Patent Jan. 14, 2022, 5 Pages. (Year: 2019).*
European Patent Office Search Report for corresponding patent application 20182772.2, dated Nov. 6, 2020, 6 pages.

* cited by examiner

FEED HOPPER FOR A MATERIAL PROCESSING DEVICE

BACKGROUND OF THE INVENTION

Field of the Invention

The invention relates to a feed hopper for a material processing device, in particular for a crusher, having two side walls and a rear wall of the hopper, wherein the side walls are directly or indirectly coupled to a machine support in a swiveling manner and can be converted from a set-up work position to a folded-down transport position and back, wherein a material feed area is formed between the side walls, and wherein at least one of the side walls is supported relative to the machine support in the set-up work position by means of a supporting device.

Description of the Prior Art

From EP 2 730 459 A2 (U.S. Pat. No. 9,242,803) a rock crusher unit having a feed hopper is known. Such feed hoppers are used in material processing devices such as rotary impact crushers, jaw crushers, cone crushers or in screening stations. A transport device, for instance a conveyor chute or belt conveyor, is assigned to the feed hopper in the area of the bottom of the hopper chamber, which is designed as a feeding area. The feed hopper is used to fill the material to be crushed and to fed it onto the transport device. Typically, excavators, wheel loaders or shredding or screening plants are used to fill feed hoppers.

The overall height of the material processing device has to be dimensioned such that it can be transported on flat-bed trucks. The overall height of the machine can be reduced by means of the fold-down side walls. A set-up aid is used to facilitate the work, to easily convert the machine.

In the set-up aid according to EP 2 730 459 A2 (U.S. Pat. No. 9,242,803), the hopper chamber is delimited by two side walls, to which a wall extension is hinged via a first swivel bearing. The set-up aid has a hydraulic cylinder as an actuator, which is coupled to the side wall in a swiveling manner. Furthermore, a support is used, which is also connected to the side wall in a swiveling manner. The support itself is connected to a lever via a second swivel bearing. The lever is coupled to the wall extension in a swiveling manner. The piston rod of the actuator engages with the area between the coupling points of the lever to the wall extension or the support. In this mechanism, the articulated shafts of the first and second swivel bearing are aligned with each other in the folded-down position of the wall extension. This allocation of articulated shafts is maintained until the wall extension reaches its set-up position. To secure the set-up position, the hydraulic cylinder must be further telescoped such that the articulated shaft of the second swivel bearing is displaced in relation to the articulated shaft of the first swivel bearing. This mechanism has the disadvantage that, due to manufacturing tolerances, it is very difficult to align the two articulated shafts of the first and second swivel bearing with each other. Accordingly, compensating mechanisms must be provided in the gear arrangement to ensure functionality. For instance, slots or the like may be provided in the area of the articulating points. However, such slots or other compensating mechanisms have the disadvantage that they result in an unstable motion sequence. In the arrangement known from EP 2 730 459 A2, the gear arrangement passes over a dead-center position, in which the wall extension performs an uncontrolled motion at least in part of the swivel motion because of the compensating mechanisms. Furthermore, the known arrangement requires a lot of cost and effort in parts and assembly.

From EP 2 949 397 B1 (U.S. Pat. No. 9,833,787) a feed hopper for a rock crusher is known, which has two hinged side walls and a rear wall of the hopper. The side walls can be locked to the rear wall of the hopper in the unfolded operating position. In addition, a linkage can be used to support the side walls. The linkage requires a lot of cost and effort in parts and assembly.

GB 2496522 A discloses a design similar to EP 2 949 397 B1. The feed hopper known from this publication again uses bipartite side walls equipped with a wall extension. The side walls can be uniformly folded down in conjunction with the attached wall extension about a horizontal swivel axis. In the unfolded position, linkages secure the position of the side wall.

DE 10 2016 119 797 B3 (CA 3035402) reveals a rock crusher having a feed hopper, which has side walls and a rear wall of the hopper. Hydraulic cylinders can be used to bring the side walls into their unfolded operating position. In the unfolded position, the side walls can be secured by means of support struts. They are attached to the side walls and the machine chassis at the attachment points provided.

SUMMARY OF THE INVENTION

The invention addresses the task of providing a feed hopper of the type mentioned above, which permits an effective securing of the side walls in the unfolded operating position with a minimum of cost and effort in parts and assembly and which, in the folded-down transport position, is accommodated in a space-saving manner.

This problem is solved by the support device having a support lever, which, in the work position, is supported directly or indirectly in relation to the machine support by means of a detachable form-fit connection, wherein the form-fit connection prevents the side wall from folding down, and the support lever projects into the material feed area in the folded-down transport position. As used herein the term "form-fit connection" means a connection that transmits force by positive engagement of one part against another such that force is transferred by one part bearing against another. This is contrasted for example with a frictional connection where the force is transmitted through the connection by friction between the two parts, or a bonded connection where the two parts are glued, welded or soldered together The support lever can be designed as a simple component, and can be attached directly to the side wall, for instance. This results in a significantly lower number of parts than for the state of the art, which in particular uses complex linkages. In the unfolded operating position, the support lever rests against the machine support based on a detachable form-fit connection. In this way, the operating position of the side wall is reliably and easily secured. If the side wall is now to be moved into the transport position, the detachable form-fit connection is a convenient way for the user to release the lock of the side wall. It can now be swiveled into the folded-down transport position. The support lever is then accommodated in a space-saving manner by swiveling into the material feed area formed between the side walls. In this way, the support lever does not affect the overall width of the material processing device and can also be integrated in the feed area in such a way that the overall height of the machine is not affected.

According to a preferred variant of invention, provision may be made that the support lever has a blocking seat, on or in which in a blocking position a lock bar rests or is inserted to form the form-fit connection, that the lock bar is coupled to an actuating element, that an actuating unit can be used to move the actuating element in the unlocking direction between the blocking position and a release position, in which the lock bar and the blocking seat are disengaged. The machine operator can easily use the actuating unit to establish or override the form-fit connection. In particular, a remote-control device can be used for this purpose to perform the actuation outside of the danger zone. The lock bar reliably secures the form-fit connection.

If provision is made to attach the support lever to the side wall and the actuating element to the machine support, this results in a wear-optimized design. The actuating element and in conjunction, the actuating unit, are then assigned to the machine support and not to the side wall, which is exposed to strong impact-like forces.

According to a preferred invention variant, provision may be made to form the actuating unit of a hydraulic cylinder and to form the actuating element of a piston rod of the hydraulic cylinder, and to orient the direction of motion of the piston rod transversely to the direction of action of the form-fit connection. By the "direction of action" of the form-fit connection it is meant the direction in which force is transferred by the form fit connection. In the operating position, the piston rod and the hydraulic cylinder are then exposed to no or only slight lateral forces, because these forces are dissipated via the form-fit connection. This results in a long service life of the hydraulic cylinder.

It is particularly preferred that the hydraulic cylinder is designed as a double-acting hydraulic cylinder, which preferably has a greater actuating force in the unlocking direction than in the opposite closing direction. The machine operator can use such a hydraulic cylinder to both establish and override the form-fit connection by remote control. Because a greater actuating force can be exerted in the unlocking direction, i.e. when the form-fit connection is overridden, the high stiction acting in the form-fit connection can be reliably overcome.

A variant of invention can be characterized in that the support lever has a locking section, which is preferably formed at the end facing away from the side wall, that the locking section in the work position is assigned to a retaining part of a blocking piece, wherein the retaining part is coupled to the machine support, that the retaining part has a form-fit element, and that the lock bar in the work position rests in a form-fit manner both against the form-fit element and against the blocking seat of the support lever transversely to the swivel direction of the side wall. In this arrangement, the supporting force required to support the side wall can be reliably transferred in the form-fit connection via the coupling point formed between the lock bar and the retaining part.

If additionally provision is made to arrange the locking section of the support lever in the work position between two retaining parts, each of which has a form-fit element, and for the lock bar to rest against the form-fit elements of the two retaining parts and against the blocking seat of the locking section, then the lock bar can be reliably released from the blocking position. This is possible in particular because the locking section is enclosed between the two retaining parts. This minimizes the risk of the lock bar becoming jammed.

If according to a variant of invention provision is made for the blocking seat of the support lever to have an orientation flank and the lock bar to have a mating surface assigned to the orientation flank, wherein the orientation flank and/or the mating surface is/are arranged inclined with respect to the motion direction of the lock bar, and that when the lock bar is moved in the direction of its locking position, the orientation flank runs up against the mating surface, then the side wall can be accurately oriented when the lock bar is moved to the locking position in the work position. Because the orientation flank runs up against the mating surface, the support lever is moved into the accurate work position.

If provision is made to use a swivel bearing to couple the lock bar to a connecting piece of the actuating element, positional tolerances can be compensated. In that way, provision may not only be made to use the swivel bearing to compensate angle differences. It is also conceivable to provide a clearance within the swivel bearing to compensate for linear misalignment.

In a further variant of the invention provision is made to provide a support piece having a bracket, to which the actuating unit is attached by means of a fastener, that the retaining part(s) is/are attached to the support piece or to the bracket, and that the bracket is detachably or permanently connected to the machine support. In this way a pre-assembled unit can be formed, which can be connected to the machine support. This unit can then be oriented exactly opposite from the machine support such that the lock bar coupled to the actuating unit and the support lever are allocated to each other in a matching manner. The unit is then fixed in place.

If provision is made that the side wall has an inner wall facing the feed area and, at the rear on the side facing away from the inner wall, is equipped with a bracing structure having at least one bracing strut, and that the integral support lever is attached, preferably welded, to the bracing structure; then a lightweight structure is provided for the side wall, wherein the support lever is nevertheless reliably supported and can reliably transfer the forces occurring during the rough operation of a construction site.

A preferred variant of invention is such that the rear wall of the hopper has lateral edge sections assigned to edge sections of the side walls in the work position, that interlocking elements are arranged in the area of the edge sections of the side walls and counter-lock bar elements are arranged in the area of the edge sections of the rear wall of the hopper, that the interlocking elements and the counter-lock bar elements are used to lock the side walls to the rear wall of the hopper in the work position, and that the support lever is preferably arranged in the area of the end of the side wall facing away from the edge section. Locking the side walls to the rear wall of the hopper results in an additional securing of the side walls and also of the rear wall of the hopper in the work position. If the support levers are arranged such that they are located in the area of the end of the side wall facing away from the edge section, this results in particularly high stability of the support of the side wall.

For a stable support of the side wall, provision may in particular also be made that the side wall has two bearing sections, which are arranged at a distance from one another and by means of which the side wall is swivel connected to the machine support using swivel bearings, and that the support lever is arranged in the area between the two bearing sections.

BRIEF DESCRIPTION OF THE DRAWINGS

The invention is explained in greater detail below based on an exemplary embodiment shown in the drawings. In the Figures.

DETAILED DESCRIPTION

Figure 1:
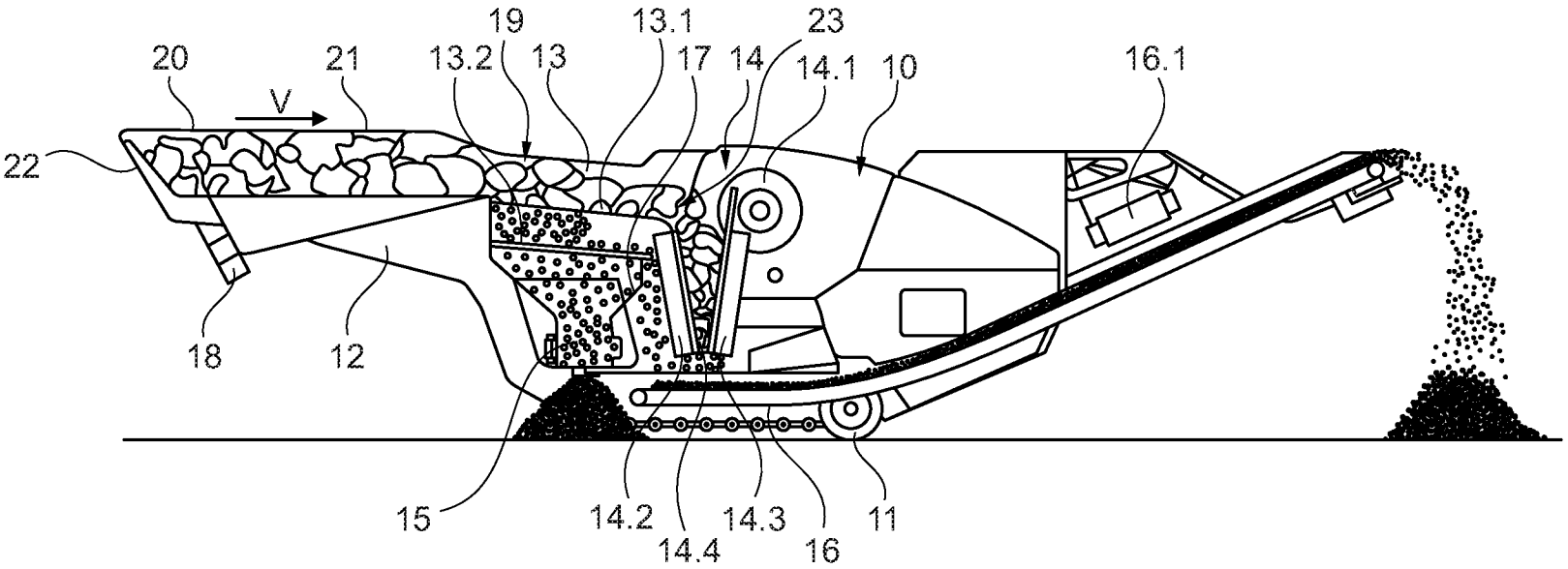
FIG. 1 shows a side view of a schematic principle representation of a mobile crusher.

FIG. 1 shows a material processing plant, namely a mobile crusher 10, as it is typically used for crushing recycling material, rocks or other mineral material. This mobile crusher 10 has a machine chassis supported by two crawler tracks 11.

The crusher 10 is equipped with a feed unit 20, which has a feed hopper. This feed hopper has two side walls 21 and a rear wall of the hopper 22. The feed unit 20 is supported by a boom 12 of the machine chassis. The boom 12 has a machine support 12.1. This machine support 12.1 is formed by a longitudinal beam extending in the longitudinal direction of the crusher 10.

This feed unit 20 can be used to fill the crusher 10 with the material to be crushed. The feed unit 20 has a transport device at the bottom, which in particular has a feed chute. This conveyor device is used to feed the material to be crushed to a screening unit 13. A vibration exciter 18 is assigned to the feed unit 20, which vibration exciter can be designed as an eccentric drive. This vibration exciter 18 can be used to vibrate the feed unit 20 to feed the material conveyed in the conveying direction V to the screening unit 13. The fed material is subjected to a screening process in the screening unit 13. The plant design can be selected such that the vibration exciter 18 causes not only the feed chute but also the screening unit 13 to vibrate for transport purposes. In particular, in conjunction with the inclined arrangement of the feed chute and/or one or more screen decks, a transport effect similar to that of a vibratory conveyor is achieved as well.

As FIG. 1 shows, the screening unit 13 feeds the coarse rock fraction, which is not screened-out, to a crusher unit 14 (transfer area 19). The crusher unit 14 is designed to have the shape of a jaw crusher. This crusher unit 14 has two crushing jaws 14.2, 14.3 that form a converging gap. The material to be crushed is fed into this gap area. The crusher unit 14 has a stationary crushing jaw 14.2 and a movable crushing jaw 14.3; the movable crushing jaw 14.3 is driven by an eccentric drive 14.1.

As FIG. 1 shows, the coarse rock material is crushed in the converging gap. On the bottom side, the crushed and broken rock material exits the crusher unit 14 in the area of a feed opening 14.4 of the converging gap and falls onto a crusher discharge belt 16 due to gravity. The crusher discharge belt 16 can, as in the present case, be designed as an endlessly circulating conveyor belt.

The crusher discharge belt 16 discharges the crushed rock material and piles it up behind crusher 10.

A magnetic separator 16.1 can be provided in the area of the crusher discharge belt 16 at the crusher 10. It is arranged above the material flow, which is routed on the crusher discharge belt 16. Magnetic or magnetizable metal parts in the material flow are magnetically attracted by the magnetic separator 16.1 and separated from the material flow.

As the drawing shows, the material coming from the feed unit 20 is passed through a pre-screen 13.1 (e.g. top screen deck) in the screening unit 13. In the process, part of the rock material is singled out. These are pieces of rock which, due to their size, do not have to be sent through crusher unit 14, as they already have a size that corresponds approximately to the rock size that results from crushing by the crusher unit 14. As the drawing shows, a part of this singled-out rock fraction is fed directly to the crusher discharge belt 16 in a bypass of the crusher unit 14.

As FIG. 1 shows, there may now be a further lower screen deck 13.2 in the screen unit 13 below the pre-screen 13.1. This lower screen deck 13.2 screens-out a further, fine partial fraction from the material already screened-out. It is now partly desired to separate this particularly fine partial fraction, for which a side discharge belt 15 is used. The fine partial fraction is fed onto this endlessly rotating side discharge belt 15, is conveyed out of the working area of crusher 10 and piled up, as shown in FIG. 1.

However, discharging the fine sub-fraction is not always desired. Rather, the machine operator wants to have the choice of feeding it separately or conjointly with the coarser screened material directly onto the crusher discharge belt 16. An adjustable flap chute 17 is used for this purpose.

Figure 2:
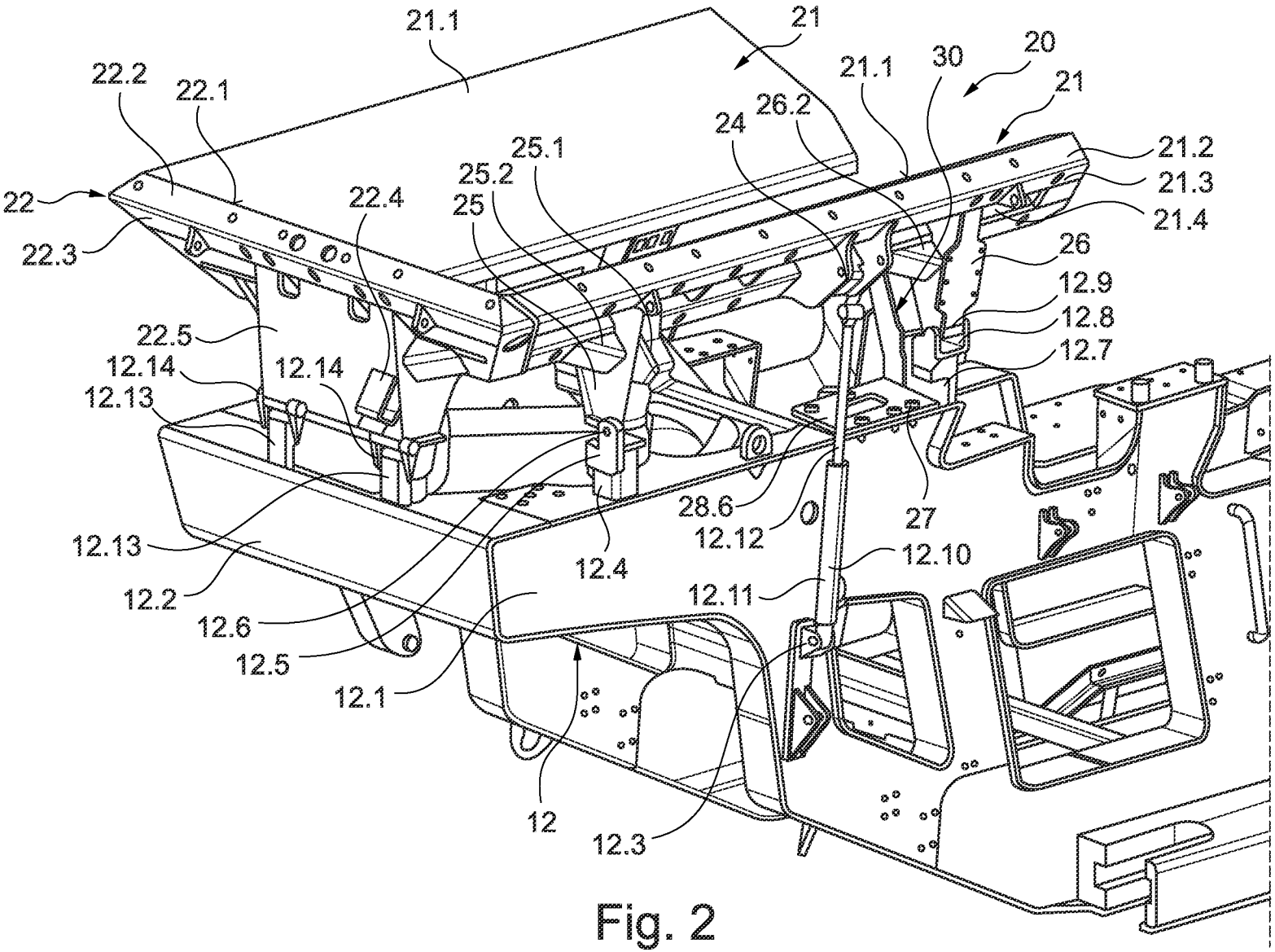
FIG. 2 shows a perspective detail view of the left rear area of the crusher as shown in FIG. 1 with a feed hopper.

As mentioned above, an excavator or the like is used to feed the material to be crushed into the crusher 10 in the area of a feed unit 20. FIG. 2 shows the feed unit 20 in more detail. As this illustration shows, the feed unit 20 has two side walls 21. These side walls 21 are essentially oriented in the conveying direction V. At the rear, the feed unit 20 has a rear wall of the hopper 22. A feed area is formed between the set-up side walls 21 and the rear wall of the hopper 22. The material to be crushed can be fed into this feed area. At the bottom, the feed area closes off with the above-mentioned conveyor unit, i.e. the conveyor chute or the conveyor belt.

The two side walls 21 can preferably be designed as mirror images of each other.

The side walls 21 have an inner wall 21.1, which is formed by a sheet metal blank. The inner wall 21.1 forms an angled edge 21.2 at the top. A chamfer 21.3 adjoins the upper edge 21.2. The upper edge 21.2 and the chamfer 21.3 are used to brace the upper part of the side wall 21. The inner wall 21.1 has a bracing structure on its side facing away from the feed area. This bracing structure is formed by bracing struts 21.4.

Figure 3:
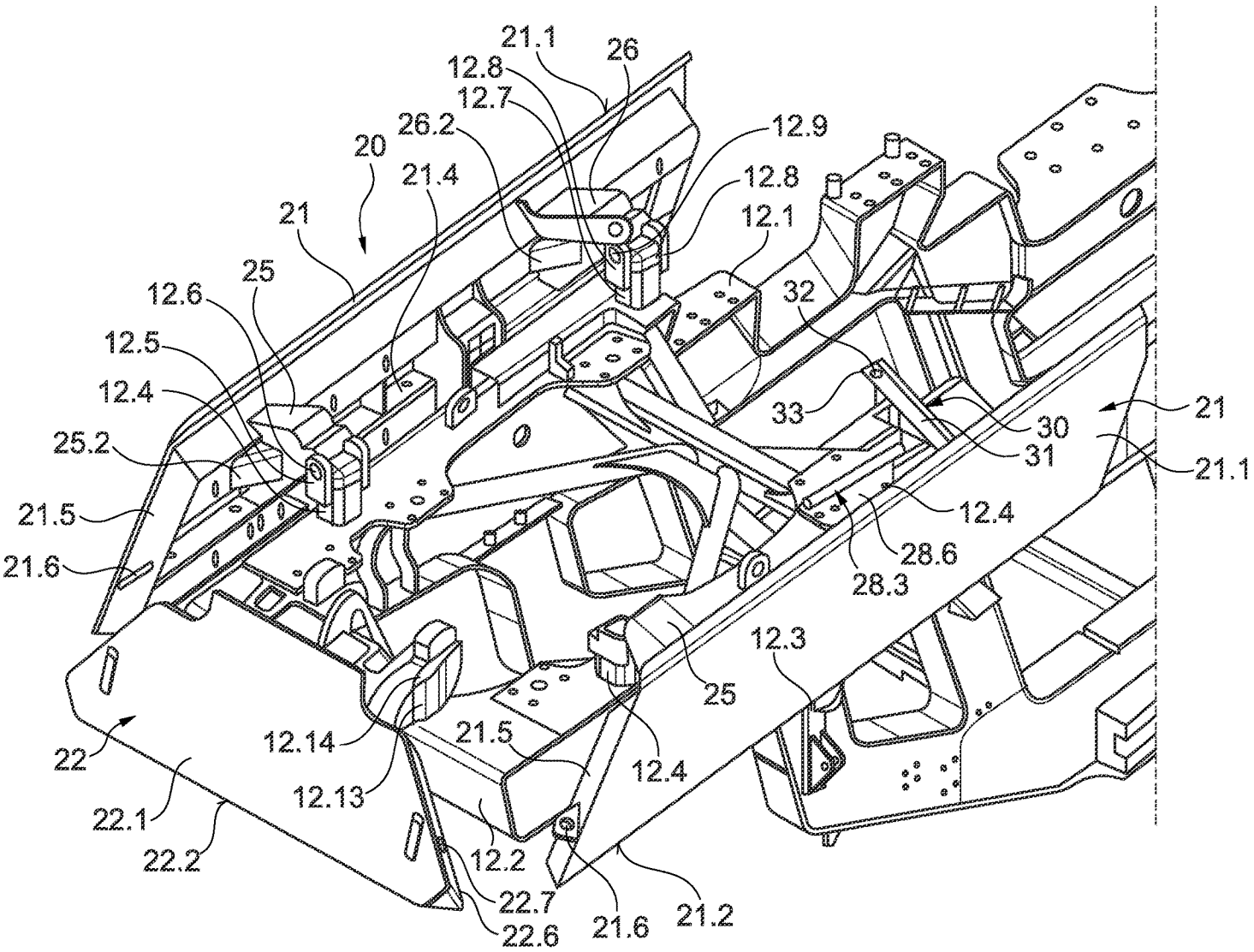
FIG. 3 shows the representation according to FIG. 2 from a different perspective, wherein the feed hopper was converted to a transport position

As FIG. 3 shows, the side walls 21 have edge sections 21.5 in their areas facing the rear wall 22 of the hopper. Interlocking elements 21.6 are provided at these edge sections 21.5. The interlocking elements 21.6 can, for instance, take the form of protruding lugs, which protrude from the edge section 21.5 and have an opening. The edge sections 21.5 may also be referred to as rear edge sections of the side walls 21.

The design of the rear wall of the hopper 22 is similar to that of the side walls 21. Correspondingly, the rear wall of the hopper 22 has an inner wall 22.1, which may be formed of a sheet metal blank. An upper edge 22.2 protrudes beyond the outside of the inner wall 22.1 and is adjoined by a chamfer 22.3. The upper edge 22.2 and the chamfer 22.3 are used to brace the upper part of the rear wall of the hopper 22.

As FIG. 2 shows, the crusher 10 has a machine chassis having a machine support 12.1. A machine support 12.1 in terms of the invention can be considered to be any component, which is part of the machine chassis or which is directly or indirectly coupled to the machine chassis and which is sufficiently strong to support at least one of the side walls 21 in the operating position shown in FIG. 2.

As FIG. 2 shows, the crusher 10 has the boom 12. This boom 12 has two longitudinal beams which are oriented in the direction of the longitudinal extension of the crusher 10. These two longitudinal members each form a machine support 12.1. At the rear, the two machine beams 12.1 are interconnected by a cross beam 12.2.

The two side walls 21 can, for instance, be attached to the machine supports 12.1 based on the same design. The explanations below therefore apply to the two side walls 21.

The machine supports 12.1 have a bearing bracket 12.4 and a bearing support 12.7. The bearing bracket 12.4 bears two lugs 12.5 with aligned drilled holes. In the same way, the bearing support 12.7 also has two lugs 12.8 having aligned drilled holes. These drilled holes are aligned with the drilled holes of bearing sections 25, 26. The bearing sections 25, 26 are attached to the external bracing structure of the side wall 21. Bearing pins can pass through the aligned drilled holes to form a swivel bearing 12.6, 12.9. The swivel axis of the two swivel bearings 12.6, 12.9 are aligned with each other. Accordingly, the side wall 21 can be moved about this common swivel axis between the work position shown in FIG. 2 and the folded-down transport position shown in FIG. 3.

As shown in FIG. 2, the lateral bracing in 25.2, 26.2 can be used to couple the bearing section 25 and/or the bearing section 26 to the side wall 21. These bracings 25.2, 26.2 not only increase the stiffness of the bearing sections 25, 26 but also that of the side wall 21 in this heavily stressed area.

As FIG. 2 further shows, the machine supports 12.1 are equipped with brackets 12.3. One actuator 12.10 each can be swivel-mounted to these brackets 12.3. The actuator 12.10 is formed by a hydraulic cylinder. Accordingly, the actuator 12.10 has a cylinder 12.11 and a piston, which can travel therein. A piston rod 12.12 is connected to the piston. At its free end, the piston rod 12.12 is connected to a support section 24 of the side wall 21 in a swiveling manner. This detail is shown more clearly in FIG. 4. As this illustration shows, the support section 24 bears a bracket 24.1. The piston rod 12.12 has a head 12.15 at its free end. This head 12.15 has a drilled hole, which is aligned with drilled holes in the bracket 24.1. A pin 24.2 can be inserted through the aligned drilled holes to form a swivel bearing. This swivel bearing is at a distance from the swivel bearings 12.6 and 12.9, wherein this eccentric assignment creates a support distance.

The rear wall of the hopper 22 has the bearing section 22.5, as described above. This bearing section 22.5 has bearing shoulders, which are assigned to two bearing brackets 12.13. The bearing brackets 12.13 are fixed to the cross beam 12.2. The bearing brackets 12.13 also have drilled holes that are aligned with the bearing shoulders of the bearing section 22.5. Swivel bearings 12.14 are formed here using bearing pins. The rear wall of the hopper 22 can be swiveled about the aligned articulated shafts of these two swivel bearings 12.14 between the work position shown in FIG. 2 and the transport position shown in FIG. 3.

FIG. 3 illustrates that the rear wall of the hopper 22 also has edge sections 22.6. The edge sections 22.6 may be referred to as lateral edge sections of the rear wall. In the operating position shown in FIG. 2, these edge sections 22.6 are assigned to the edge sections 21.5 of the side walls 21. The counter-lock bar elements 22.7 shown in FIG. 3 are arranged in the area of the edge sections 22.6. These counter-lock bar elements 22.7 may, for instance, be formed by movable pins. These movable pins engage with the openings of the interlocking elements 21.6 of the side walls 21 when the latter are in the operating position. The form-fit interlock formed in this way secures the operating positions of the side walls 21 and of the rear wall of the hopper 22.

As FIGS. 2 and 3 illustrate, a support device 30 is arranged on each of the two side walls 21. This support device 30 comprises at least one support lever 31. The support lever 31 is designed as a rigid integral lever.

The support lever 31 has a fastening segment 34. This fastening segment 34 is used to attach the support lever 31 to the side wall 21. Preferably the fastening segment 34 is mounted on the outside of the inner wall 21.1 and further preferably in particular on at least one of the bracing struts 21.4 of the bracing structure. The fastener is preferably formed by a material bond, in particular a welded joint.

The integral lever-shaped locking section 33 adjoining the fastening segment 34 projects from the side wall 21. The locking section 33 has a blocking seat 32. This blocking seat 32 can, as in this exemplary embodiment, be formed by an opening, which is inserted into the locking section 33.

As FIG. 3 shows, the support lever 31 is arranged in the area between the bearing bracket 12.4 and the bearing support 12.7. The arrangement is such that the support lever 31 is located in the area of the end of the side wall 21 facing away from the rear wall of the hopper 22 to provide stable support for the side wall 21.

As FIG. 3 shows, the support lever 31 projects into the feed area in a space-saving manner if the side walls are in the folded-down position, which they assume in the transport position. In the upright operating position, as shown in FIG. 2, the locking section 33 of the support lever 31 is assigned to a blocking piece 27. This can be more clearly seen in FIG. 4.

Figure 4:
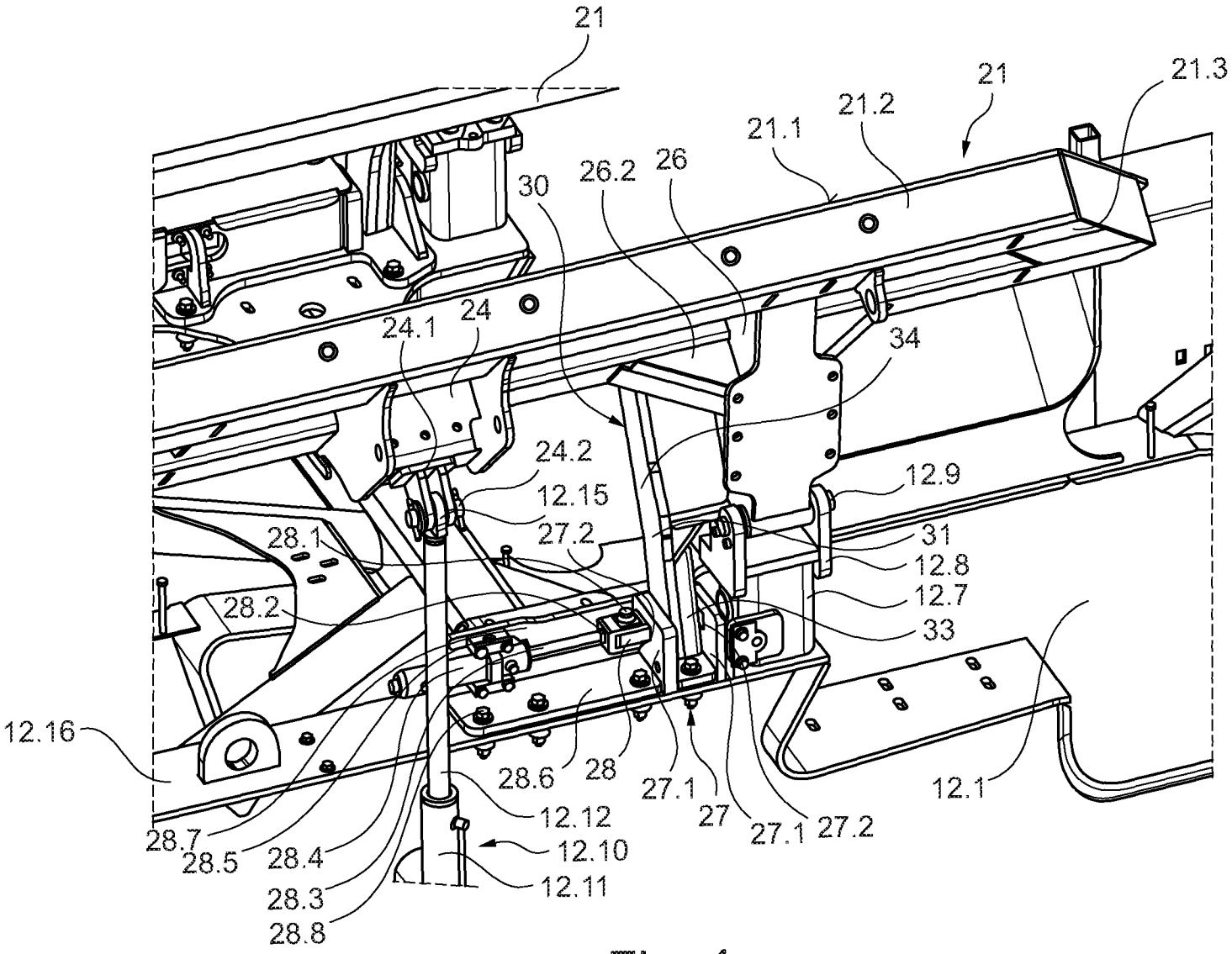
FIG. 4 shows a detailed representation taken from FIG. 2.

As FIG. 4 shows, the blocking piece 27 has two retaining parts 27.1, which are spaced apart from each other. The retaining parts 27.1 can be formed by plate-shaped elements. Every retaining part 27.1 has a form-fit element 27.2. As the drawings illustrate, this form-fit element 27.2 can be formed by a breakthrough in the retaining parts 27.1. The openings in the two retaining parts 27.1 are aligned with each other. The retaining parts 27.1 are attached to a support piece 28.7. The support piece 28.7 may be designed to be plate-shaped. It is connected to a bracket 28.6, wherein the connection between the bracket 28.6 and the support piece 28.7 is preferably formed by a welded joint. In the same way, the retaining parts 27.1 can be connected to the bracket 28.6 or to the support piece 28.7, for instance by welding. The locking piece 27 also bears an actuating unit 28.4. In this example a fastener 28.5 is used to attach the actuating unit 28.4 to the support 28.7. The actuating unit 28.4 is formed by a hydraulic cylinder. This hydraulic cylinder also comprises a piston rod, which forms an actuating element 28.3. A connecting piece 28.2 is provided at the end of the actuating element 28.3. A lock bar 28 is connected to the connecting piece 28.2 via a swivel bearing 28.1. The actuating unit 28.4 may also be referred to as an actuator.

The blocking piece 27 forms a pre-assembled unit in conjunction with the bracket 28.6, the support piece 28.7, the actuating unit 28.4 and the lock bar 28. Bolts 28.8 can be used to connect this pre-assembled unit to a flange 12.16 of the machine support 12.1. The assignment to the machine support 12.1 is such that in the operating position shown in FIG. 4, the support lever 31 comes to rest between the two retaining parts 27.1. In particular, the blocking receiver 32 of the support lever 31 is aligned with the two form-fit elements 27.2 of the retaining parts 27.1. As FIG. 4 shows, the lock bar 28 secures this operating position. The lock bar 28 passes through the aligned form-fit elements 27.2 and the blocking seat 32. In this way, a form-fit connection is formed, wherein a form fit is formed transverse to the swivel direction of the side wall 21. In this way, the side wall 21 is blocked against the machine support 12.1 in a form-fitting manner. Preferable the form-fit connection acts in both the unfolding and the fold-down direction. In this way a secure immobilization of the side wall 21 is achieved. However, this is not mandatory in accordance with the invention. In particular, it may only be provided that the form-fit connection is effective in the fold-down direction.

To move the side walls 21 from the operating position shown in FIGS. 2 and 4 to the transport position shown in FIG. 3, first the connection between the rear wall of the hopper 22 and the side walls 21 (interlocking element 21.6 and counter-lock bar elements 22.7) is released. Then, suitable devices, for instance of an actuator not shown in the drawings, can be used to move the rear wall of the hopper 22 into the folded-down transport position shown in FIG. 3.

Simultaneously or afterwards, the side walls 21 can be swiveled. To this end, first the actuating unit 28.4 is activated and then the actuating element 28.3 is retracted. In this way, the lock bar 28 and the blocking seat 32 of the support lever 31 are disengaged. Consequently, the support lever 31 is released and no longer connected to the blocking piece 27. Now the actuator 12.10 can be activated, wherein the piston rod 12.12 is retracted. This causes the side wall 21 to swivel about the swivel axis formed by the swivel bearings 12.6 and 12.9. During this swivel motion, the locking section 33 of the support lever 31 in FIG. 4 moves backwards 'into the image' out of the fitting formed between the two retaining parts 27.1. As a result of the swiveling motion of the side wall 21, the support lever 31 also swivels until it reaches the position shown in FIG. 3 and comes to rest in the feed area between the two side walls 21.

Stops 22.4 and 25.1 can be provided to limit the swinging motion of both the rear wall of the hopper 22 and/or the side walls 21. The stop 22.4 can, for instance, be provided on the bearing section 22.5 of the rear wall of the hopper 22. The stop 25.1 can, for instance, be provided at the bearing section 25 of the side wall 21. These bearing sections 25 offer a stable coupling point for the stop 22.4 or 25.1.

To set up the side walls 21 or the rear wall of the hopper 22 from the transport position shown in FIG. 3 to the operating position shown in FIG. 2, the operating procedure described above has to be followed in reverse order.

As explained above, the lock bar 28 passes through the blocking seat 32 of the support lever 31 and the aligned form-fit elements 27.2 of the retaining parts 27.1. Accordingly, the force is transferred from the support lever 31 into the retaining parts 27.1 via the lock bar 28, in particular via the form-fit connections formed there. The direction of force is transverse to the actuating direction of the piston rod (actuating element 28.3). The piston rod is thus at least largely free from transverse forces permitting a low-stress operating mode of the actuating unit 28.4. In particular, any bending of the piston rod is prevented.

It may also be provided that the lock bar 28 has a wedge-shaped geometry. If it is then inserted into the blocking seat 32 of the support lever 31, an orienting flank of the wedge-shaped geometry of the lock bar 28 runs up against a mating surface of the blocking seat 32. In this way the support lever 31 can be oriented exactly opposite from the blocking piece 27. This orientation then makes for an exact orientation of the side wall 21 in the operating position.

The invention claimed is:

1. A feed hopper for a material processing device, comprising:

a machine support;

first and second side walls pivotally connected to the machine support, the side walls each being pivotable between a set-up work position wherein a feed area is formed between the side walls, and a folded-down transport position;

a rear wall pivotally connected to the machine support;

a support lever;

a releasable form-fit connection configured such that in the set-up work position the support lever is supported directly or indirectly from the machine support by the form-fit connection to prevent the first side wall from folding down from its set-up work position; and wherein the support lever is configured such that when the first side wall is in the folded-down transport position the support lever projects into the feed area.

2. The feed hopper of claim 1, wherein:

the form-fit connection includes a blocking seat defined on the support lever and a lock bar configured to engage the blocking seat to form the form-fit connection; and the feed hopper further comprises an actuator including an actuating element connected to the lock bar and configured to move the lock bar between a blocking position in which the lock bar is engaged with the blocking seat and a release position in which the lock bar and the blocking seat are disengaged.

3. The feed hopper of claim 2, wherein:

the support lever is attached to the first side wall and the actuator is attached to the machine support.

4. The feed hopper of claim 2, wherein:

the actuator includes a hydraulic cylinder and the actuating element includes a piston rod of the hydraulic cylinder, and a direction of motion of the piston rod is oriented transversely to a direction of action of the form-fit connection.

5. The feed hopper of claim 4, wherein:

the hydraulic cylinder is a double-acting hydraulic cylinder.

6. The feed hopper of claim 5, wherein:

the double acting hydraulic cylinder has a greater actuating force in an unlocking direction for disengaging the lock bar from the blocking seat than in an opposite closing direction for engaging the lock bar with the blocking seat.

7. The feed hopper of claim 2, wherein:

the feed hopper further includes a retaining part attached to the machine support, the retaining part including a form-fit element; and wherein when the first side wall is in the work position and the lock bar is engaged with the blocking seat, the lock bar also engages the form-fit element of the retaining part to form a second form-fit connection.

8. The feed hopper of claim 7, further comprising:

a bracket attached to the machine support;

wherein the actuator is attached to the bracket by a fastener; and wherein the retaining part is attached to the bracket.

9. The feed hopper of claim 2, wherein:

the feed hopper further includes a blocking piece attached to the machine support, the blocking piece including two retaining parts, the retaining parts each including a form-fit element; and wherein when the first side wall is in the work position the blocking seat of the support lever is received between the two retaining parts of the blocking piece, and when the lock bar is engaged with the blocking seat, the lock bar also engages the form-fit elements of the two retaining parts to form two further form-fit connections.

10. The feed hopper of claim 2, wherein:

the actuating element includes a connecting piece, and the lock bar is coupled to the connecting piece by a swivel bearing.

11. The feed hopper of claim 1, wherein:

the first side wall includes an inner wall facing the feed area, and a bracing structure on a side facing away from the inner wall, the bracing structure including at least one bracing strut, wherein the support lever is welded to the bracing structure.

12. The feed hopper of claim 1, wherein:

each of the first and second side walls includes a rear edge section including an interlocking element; and the rear wall includes lateral edge sections each including a counter-lock element configured to cooperate with one of the interlocking elements to lock the side walls to the rear wall in the work position.

13. The feed hopper of claim 12, wherein:

the support lever is located nearer to a forward end of the first side wall than to the rear edge section of the first side wall.

14. The feed hopper of claim 1, wherein:

the first side wall is pivotally connected to the machine support by two spaced bearing sections; and the support lever is arranged between the two spaced bearing sections.

15. The feed hopper of claim 1, further comprising:

a hydraulic cylinder connected between the first side wall and the machine support and configured to move the first side wall between the transport position and the work position.

* * * * *